US007043859B1

(12) United States Patent
Meyer

(10) Patent No.: US 7,043,859 B1
(45) Date of Patent: May 16, 2006

(54) DISPLAY SIGN CARD RETAINER

(75) Inventor: P. Allan Meyer, Fort Worth, TX (US)

(73) Assignee: May Advertising International, Ltd., Fort Worth, TX (US)

( * ) Notice: Subject to any disclaimer, the term of this patent is extended or adjusted under 35 U.S.C. 154(b) by 110 days.

(21) Appl. No.: 10/763,853

(22) Filed: Jan. 23, 2004

(51) Int. Cl.
*G09F 11/02* (2006.01)

(52) U.S. Cl. ..... 40/497; 40/492; 40/588; 40/533

(58) Field of Classification Search ..... 40/111, 40/114, 119, 492, 493, 497, 500, 530, 533, 40/536, 537, 588, 590, 606.09; 292/194, 292/219, 202–204, 228; 24/DIG. 59
See application file for complete search history.

(56) References Cited

U.S. PATENT DOCUMENTS 1,487,586 A * 3/1924 MacNicol ..... 40/119
1,685,080 A * 9/1928 Auchincloss ..... 40/588
2,388,180 A * 10/1945 Pulver, Jr. ..... 40/611.01
2,634,146 A * 4/1953 Johnson ..... 292/194
3,437,365 A * 4/1969 Zadanoff et al. ..... 292/202
4,138,787 A * 2/1979 Sarkisian et al. ..... 40/618
6,378,232 B1 * 4/2002 Creech ..... 40/606.15
6,481,054 B1 * 11/2002 Hillstrom ..... 16/252
6,546,655 B1 * 4/2003 Hillstrom ..... 292/54
6,665,967 B1 * 12/2003 Quackenbush ..... 40/588

* cited by examiner

*Primary Examiner*—Joanne Silbermann
(74) *Attorney, Agent, or Firm*—Bracewell & Giuliani LLP

(57) ABSTRACT

A display sign has cards that fold on a hinge to display different numerals. An upper latch retains cards in an upper position overlying an upper edge of the cards. The latch has a retaining member that rotates between an open position and a locked position. A lock assembly for the retaining member has a threaded member that is rotatable between a locked position, which prevents movement of the retaining member, to an unlocked position, which allows the retaining member to rotate.

17 Claims, 2 Drawing Sheets

DISPLAY SIGN CARD RETAINER

FIELD OF THE INVENTION

This invention relates in general to display signs for displaying prices located on flip cards.

BACKGROUND OF THE INVENTION

One type of display sign often used at convenience stores and at gasoline stations utilizes numbers located on cards that can be readily changed. The numbers identify prices, such as for cigarettes. The cards are mounted to a plate of the sign by a hinge, allowing each card to be flipped or folded from a lower position below the hinge to an upper position above the hinge. Half of the number to be displayed is on the backside of the upper card and the other half is on the front side of the lower card. A latch will latch the card located in the upper position in place.

One prior art latch comprises a rotatable retaining member that has a lobe portion that overlies an edge of the card when rotated to the retained position. The retaining member rotates about an axis that is perpendicular to the plane containing the plate.

One problem with this type of sign is that the latch does not lock in place. The retaining member may be freely rotated by anyone that can reach it. Consequently, if the sign is accessible to customers, it is possible for a customer to move the retaining member to a released position and flip the cards to change the price displayed. At times, customers demand that the product be sold at the erroneous price.

SUMMARY OF THE INVENTION

The display sign of this invention has a support plate with a plurality of cards located on the forward side of the plate. A hinge retains each of the cards to enable the cards to be folded from a lower position below the hinge to an upper position above the hinge. A retaining member, located above the hinge, has a periphery with a lobe portion. The retaining member is rotatable from a retaining position, wherein the lobe portion points downward and overlies an edge the upper cards, to an open position wherein the lobe portion is free of the edges of the cards.

A lock assembly for the retaining member includes a threaded member. The threaded member is rotatable between a locked position, preventing rotation of the retaining member while in the retaining position, and an unlocked position that allows rotation member from the retaining to the open position.

In the preferred embodiment, the threaded member comprises a fastener with a head on one end. The fastener engages a threaded receptacle that is mounted to the rearward side of the support plate. The fastener extends through a cavity of the retaining member into engagement with the threaded receptacle. A spring, between a shoulder in the cavity and the head of the fastener, urges the retaining member toward the support plate. The retaining member has a tab or lug on its rearward side that engages an aperture provided in the support plate. While in engagement with the aperture, the lock member prevents any rotation of the retaining member.

To lock the retaining member, the user uses a tool to engage and rotate the head of the threaded fastener, causing the lug to enter the aperture. The head bears against the forward side of the retaining member, pressing it tightly against the support plate and any cards that the retaining member is holding in the upper position. To change the numbers, the user uses the tool to rotate the fastener in an opposite direction for an amount sufficient to allow the lug to clear the aperture. By pulling the retaining member away from the support plate when the fastener is loose, the user can free the lug from the aperture and rotate the retaining member to an open position.

DETAILED DESCRIPTION OF THE INVENTION

Figure 1:
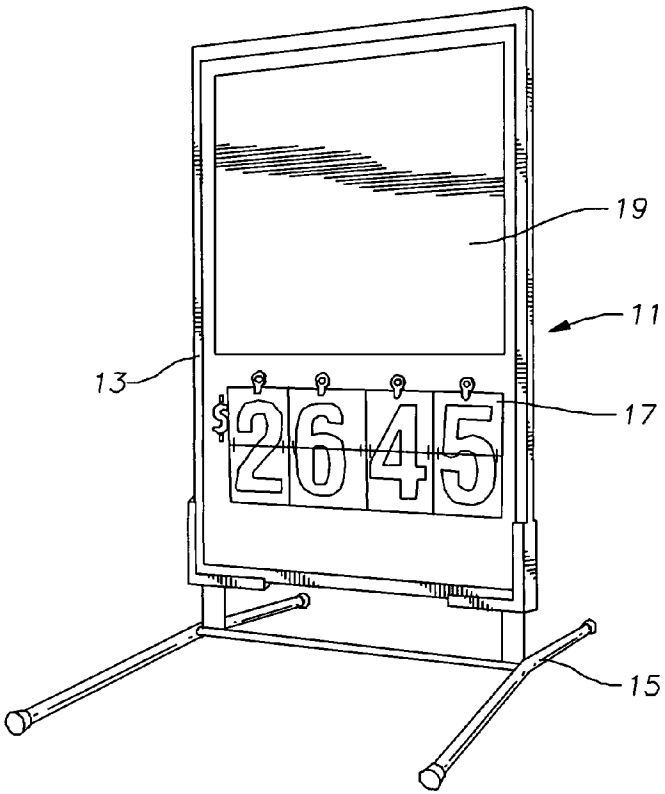
FIG. 1 is a perspective view of a display sign constructed in accordance with this invention.

Referring to FIG. 1, display sign 11 has a frame 13. In the embodiment shown, a set of legs 15 supports frame 13 in a vertical position. Alternately, frame 13 can be supported on a vertical pole, or have lateral arms that mount to a building or a pole.

Display sign 11 has a plurality of cards 17 that display a selected price. In this embodiment, there are four columns of cards 17, each card displaying a numeral from 0 to 9. The display by cards 17 in each column can be changed from 0 to 9 by folding or flipping certain of the cards between lower and upper positions. In this embodiment, display sign 11 also has an advertising portion 19 located above cards 17, but this is not essential to the invention.

Figure 2:
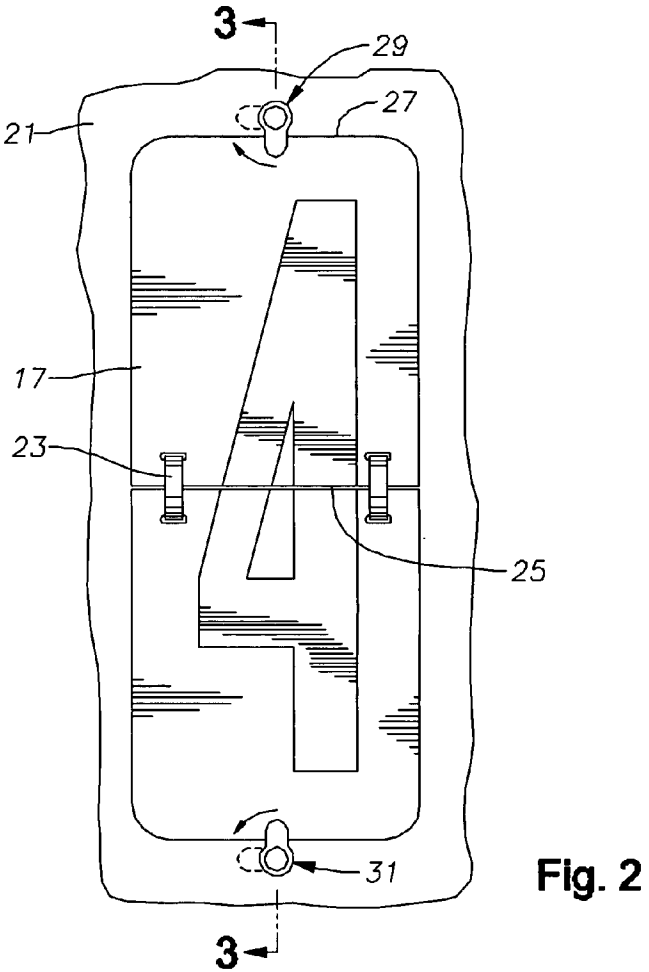
FIG. 2 is an enlarged front view of a portion of the display sign of FIG. 1.

Referring to FIG. 2, display sign 11 includes a support plate 21 that is located in a single plane in the preferred embodiment and mounted to frame 13 (FIG. 1). Each column of cards 17 has a pair of hinges 23. Hinges 23 may vary, but in this embodiment comprise arcuate bands spaced apart from each other. Hinges 23 are permanently fixed to plate 21, such as by rivets. Hinges 23 extend through slots along the first edge 25 of each card 17 in that particular column.

Preferably, each numeral has an upper portion on the backside of one of the cards 17 and a lower portion on the forward side of adjacent card 17. Consequently, when the forward and backsides of adjacent cards 17 are folded out as shown, the total numeral is shown, such as the numeral 4 in FIG. 2. When the card 17 shown above hinge 23 in FIG. 2 is folded downward, numeral 3 will be displayed. When the card 17 below hinge 23 in FIG. 2 is folded upward, the numeral 5 will be displayed.

Each card 17 has a second edge 27 that is located opposite first edge 25, edges 25, 27 being parallel to each other in this embodiment. An upper latch 29 is movable from an open position, shown by the dotted lines, to a closed position overlying a portion of second edge 27 of the card or cards 17 located above hinge 23. When upper latch 29 is in the retaining position shown by the solid lines, the cards 17 in the upper position above hinge 23 are prevented from falling by gravity back to the lower position.

Optionally, a lower latch 31 may be employed below hinges 23 to engage the second edge 27 of the cards 17 when located in the lower position. However, lower latch 31 is not essential because even if it were not there, a lower card 17 flipped to the upper position will not stay in the upper position unless retained by upper latch 29. If a lower latch 31 is used, it may be a conventional type and need not lock in a retaining position.

Figure 4:
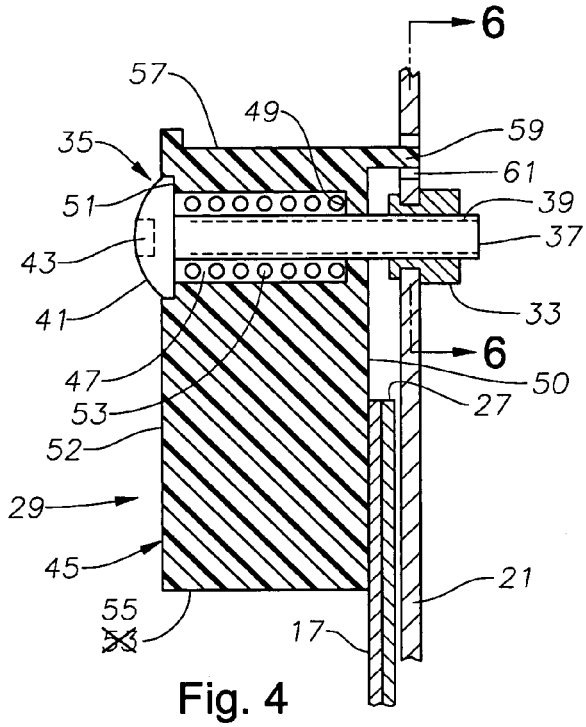
FIG. 4 is an enlarged sectional view of the upper latch shown in FIG. 3.

Referring to FIG. 4, a threaded receptacle 33 is mounted to the rearward side of support plate 21. Threaded receptacle 33 is preferably a rivet that is fixed in place and has a threaded bore. A fastener 35 has a shank 37 with threads 39 for engaging receptacle 33. Fastener 35 is located on the forward side of plate 21 and is perpendicular or normal to a plane containing plate 21. A head 41 is integrally formed on shank 37 of fastener 35 in this embodiment. Head 41 has a tool profile 43 for engagement by a tool to rotate fastener 35. In the preferred embodiment, profile 43 comprises a polygonal socket for receiving an Allen wrench, but it could be other shapes.

Fastener 35 holds a retaining member 45 on the forward side of plate 21. Retaining member 45 has a hole or cavity 47 through which fastener shank 37 extends. Cavity 47 has a first shoulder 49 that is located near a rearward side of retaining member 45. A second shoulder 51 is located in cavity 47 near forward side 52 of retaining member 45. Cavity 47 thus has a smallest diameter at rearward side 50, a largest diameter at forward side 52, and an intermediate diameter between shoulders 49, 51. A coil spring 53 is located within the intermediate portion of cavity 47, having one end that engages first shoulder 49 and another end that engages fastener head 41, which serves as a rearward facing shoulder. Second shoulder 51 is slightly larger in diameter than the diameter of fastener head 41, preventing fastener head 41 from entry into the intermediate portion of cavity 47 between shoulders 49, 51.

Figure 5:
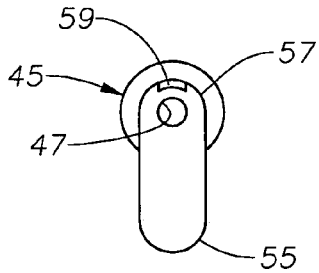
FIG. 5 is a view of the rearward side of the retainer of the upper latch of FIG. 4.

As shown in FIG. 5, retaining member 45 is eccentric about an axis of cavity 47, which is its axis of rotation. Retaining member 45 has a lobe portion 55 that extends farther from the axis of cavity 47 than a clearance portion 57. Clearance portion 57 extends approximately 90 degrees to 270 degrees from the center of lobe portion 55.

Figure 6:
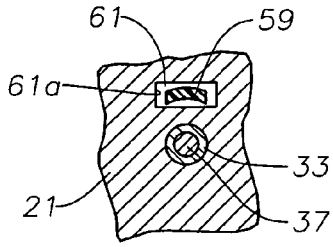
FIG. 6 is a sectional view of the upper latch of FIG. 4, taken along the line 6—6 of FIG. 4.

A lug 59 in the preferred embodiment is integrally formed on rearward side 50 of retaining member 45 and protrudes rearwardly therefrom. Lug 59 is a thin arcuate member in the preferred embodiment, as shown in FIGS. 5 and 6, but it could also be of other configurations, such as cylindrical. Lug 59 is located preferably in clearance portion 57, 180 degrees from the center of lobe portion 55. Lug 59 engages an aperture 61 (FIG. 6) formed in plate 21 adjacent receptacle 33. In this embodiment, aperture 61 is rectangular, however it could be arcuate with the same shape as lug 59 or have different shapes. Aperture 61 has side edges 61*a* (FIG. 6) that are slightly farther apart than the distance between the side edges of lug 59. Consequently, when lug 59 is located within aperture 61, retaining member 45 cannot rotate about threaded shank 37.

Lower latch 31 could be identical to upper latch 29, but need not be. In the embodiment shown in FIG. 3, lower latch 31 has a fastener shank 63 with a rearward head 65 and a forward head 67. The distance between heads 65, 67 is fixed, thus one of the heads is formed by swaging or the like after insertion through a hole in support plate 21. Retaining member 69 does not have a lug on its rearward side. Retaining member 69 has a cavity 71 containing a coil spring 73 that biases retaining member 69 toward support plate 21. There is no aperture in support plate 21 adjacent fastener shank 63 for receiving a lug. Retaining member 69 does not lock in the retaining position, rather can be freely rotated.

In operation, an authorized person will loosen fastener 35 by rotating counterclockwise using an Allen tool (not shown) to engage tool profile 43. It is not necessary to completely unscrew fastener 35, and optionally a stop (not shown) prevents complete removal. The operator loosens fastener 35 only sufficiently for lug 59 to disengage from aperture 61. Because spring 53 urges retaining member 45 against plate 21, the operator may use one hand to pull retaining member 45 away from plate 21 once fastener 35 is loosened until lug 59 is out of engagement with aperture 61. The operator then rotates retaining member 45 anywhere from 90 degrees to 270 degrees from the position shown in FIGS. 2, 3 and 4. This places lobe portion 55 free of second edge 27 of any of the cards 17. The operator rotates lower latch 31 to the open position, either before or after rotating upper latch 29 to the retaining position. The operator then folds cards 17 to a desired presentation of a numeral.

Figure 3:
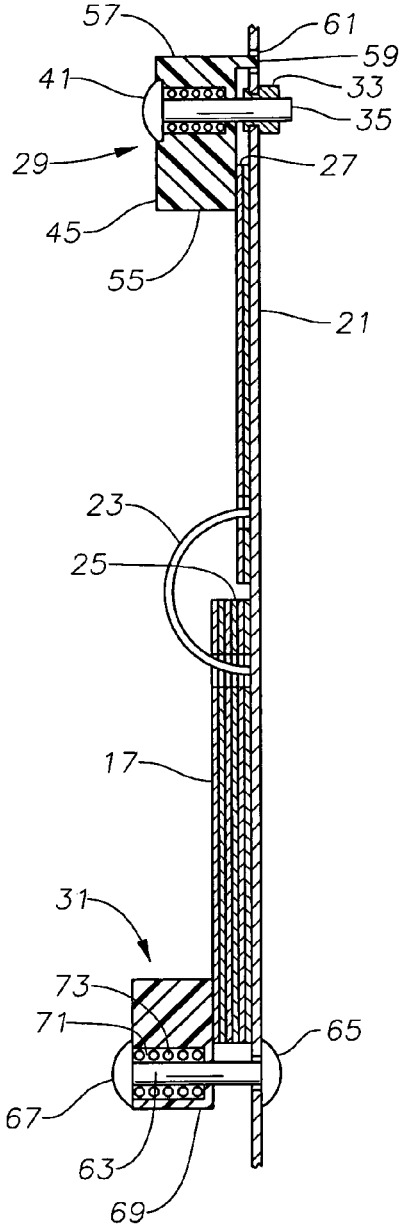
FIG. 3 is a sectional view of the display sign of FIG. 1, taken along line 3—3 of FIG. 2.

The operator then rotates retaining member 45 to the retaining position with lobe portion 55 pointing downward as shown in FIGS. 2, 3 and 4. This position aligns lug 59 with aperture 61. Spring 53 causes lug 59 to slide into aperture 61, preventing any further rotation of retaining member 45 about fastener 35. The operator then uses a tool to rotate fastener 35 clockwise, tightening it into threaded receptacle 33. When fully tight, head 41 will be bearing against second shoulder 51, and a portion of rearward side 50 at lobe portion 55 will be bearing against and overlie second edge 27 of cards 17. Once tightly secured, fastener 35 can be rotated only by use of an Allen key wrench. Retaining member 45 may be cocked slightly relative to the axis of fastener 35, as shown in FIG. 3, depending upon the number of cards 17 that it is retaining. Optionally, if the rearward portion of cavity 17 is sized to fit closely enough with fastener shank 37, then very little cocking occurs. Normally, as shown in FIG. 4, the rearward side 50 of retaining member 45 engages only the cards 17 and not any portion of support plate 21. However, retaining member 45 will still function in the same manner even if a portion of its rearward side contacts support plate 21.

The lock assembly in the preferred embodiment includes rotatable threaded fastener 35, threaded receptacle 33, as well as lug 59 and aperture 61. Alternately, fastener shank 37 could be fixed against rotation, and head 41 made rotatable on the threads of shank 37 to change the axial position of head 41 relative to support plate 21. Further, although retaining member 45 preferably rotates about an axis that is normal to the plane of support plate 21, retaining member 45 could be made to rotate about a shaft located in a plane parallel to support plate 21. In such instance, the threaded member could be an Allen screw that engages a recess in the shaft about which the retaining member rotates.

The invention has significant advantages. The lock assembly is readily moved between open and closed positions. The lock assembly needs no special codes or key, yet can be securely locked in place against unauthorized movement.

While the invention has been shown in only one of its forms, it should be apparent to those skilled in the art that it is not so limited but is susceptible to various changes without departing from the scope of the invention.

I claim:

1. In a display sign having a support plate, a plurality of cards, and a hinge that retains each of the cards to enable the cards to be folded from one side of the hinge to another side of the hinge to display numerals, the improvement comprising:

a retaining member having a periphery containing a lobe portion and being rotatable from a retaining position, wherein the lobe portion overlies an edge portion of one of the cards, to an open position, wherein the lobe portion is free of the edge portion of said one of the cards; and a lock assembly on the retaining member that includes a threaded member that is rotatable between a locked position, preventing rotation of the retaining member while in the retaining position, and an unlocked position that allows rotation of the retaining member from the retaining to the open position, the lock assembly further comprises an aperture formed in the support plate and a lug on the retaining member that engages the aperture while the threaded member is in the locked position and disengages from the aperture while the threaded member is in the unlocked position.

2. The display sign according to claim 1, wherein the lock assembly further comprises a threaded receptacle stationarily carried by the support plate, the threaded member engaging the threaded receptacle.

3. The display sign according to claim 1, wherein the retaining member is rotatable about an axis of the threaded member between the retaining and open positions.

4. The display sign according to claim 1, wherein the lock assembly moves the retaining member toward the support plate while the threaded member is being rotated in one direction and away from the support plate while the threaded member is being rotated in an opposite direction.

5. The display sign according to claim 1, wherein the lug is located on a periphery of the retaining member opposite from the lobe portion.

6. The display sign according to claim 1, wherein:

the lock assembly moves the retaining member toward the support plate while the threaded member is being rotated toward the locked position and away from the support plate while the threaded member is being rotated toward the unlocked position; and the retaining member is biased toward the support plate.

7. A display sign, comprising:

a support plate;

at least one card;

a fastener having a head and a threaded shank that engages a threaded receptacle mounted to the support plate adjacent an edge of the card;

a retaining member having a cavity through which the shank of the fastener extends, the retaining member being rotatable about an axis of the shank from a retaining position overlying an edge of the card to an open position free of the edge of the card;

an aperture in the support plate adjacent the fastener;

a lug on the retaining member for selective engagement with the aperture when the retaining member is in the retaining position, preventing rotation of the retaining member to the open position; and wherein rotating the fastener in a first direction moves the head closer toward the support plate to a locked position, wherein the head of the fastener prevents the lug from disengagement with the aperture, and rotating the fastener in a second direction moves the head away from the support plate to an unlocked position, wherein the head of the fastener allows the lug to be disengaged from the aperture.

8. The display sign according to claim 7, further comprising a spring mounted between the head of the fastener and the retaining member for urging the retaining member toward the support plate.

9. The display sign according to claim 7, wherein the threaded receptacle is stationarily mounted to a rearward side of the support plate, and the shank of the fastener protrudes from a forward side of the support plate.

10. The display sign according to claim 7, wherein the spring comprises a coil spring encircling the shank of the fastener, the spring being compressed between the head of the fastener and a shoulder formed in the cavity.

11. The display sign according to claim 7, wherein the retaining member has a periphery that includes a lobe portion and a clearance portion, the lobe portion protruding radially farther from the axis than the clearance portion to overly an edge of the card.

12. The display sign according to claim 7, wherein the head of the fastener bears against the retaining member while in the locked position.

13. The display sign according to claim 7, wherein:

the retaining member has a periphery that includes a lobe portion and a clearance portion, the lobe portion protruding radially farther from the axis of the shank than the clearance portion to overly an edge of the card; and the lug is located on the periphery of the retaining member opposite from the lobe portion.

14. In a display sign having a support plate, a plurality of cards, and a hinge that retains each of the cards to enable the cards to be folded from one side of the hinge to another side of the hinge to display numerals, the improvement comprising:

a retaining member having a periphery containing a lobe portion and being rotatable from a retaining position, wherein the lobe portion overlies an edge portion of one of the cards, to an open position, wherein the lobe portion is free of the edge portion of said one of the cards, the retaining member being biased toward the support plate; and a lock assembly on the retaining member that includes a threaded member that is rotatable between a locked position, preventing rotation of the retaining member while in the retaining position, and an unlocked position that allows rotation of the retaining member from the retaining to the open position, the lock assembly moves the retaining member toward the support plate while the threaded member is being rotated toward the locked position and away from the support plate while the threaded member is being rotated toward the unlocked position.

15. The display sign according to claim 1, wherein the lock assembly further comprises a threaded receptacle stationarily carried by the support plate, the threaded member engaging the threaded receptacle.

16. The display sign according to claim 1, wherein the retaining member is rotatable about an axis of the threaded member between the retaining and open positions.

17. The display sign according to claim 1, wherein the threaded member is rotated in one direction while moving the retaining member toward the locked position, and rotated in an opposite direction while moving the retaining member toward the unlocked position.

* * * * *